US006606478B2

(12) United States Patent
Fayette et al.

(10) Patent No.: US 6,606,478 B2
(45) Date of Patent: Aug. 12, 2003

(54) COMPOSITE TRANSFER ASSIST BLADE

(75) Inventors: Michael A. Fayette, Walworth, NY (US); Andrew J. Bonacci, Rochester, NY (US); Bruce J. Parks, Bloomfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/043,347

(22) Filed: Jan. 14, 2002

(65) Prior Publication Data

US 2003/0039488 A1 Feb. 27, 2003

Related U.S. Application Data

(60) Provisional application No. 60/315,228, filed on Aug. 27, 2001.

(51) Int. Cl.[7] ..... G03G 15/16
(52) U.S. Cl. ..... 399/316
(58) Field of Search ..... 399/316, 297, 399/317, 398, 399

(56) References Cited

U.S. PATENT DOCUMENTS 4,464,042 A * 8/1984 Omori et al. ..... 399/316
4,751,547 A * 6/1988 Fratangelo ..... 399/398
5,300,994 A 4/1994 Gross et al. ..... 355/277
5,613,179 A 3/1997 Carter et al. ..... 399/316
5,720,094 A 2/1998 Carter et al. ..... 29/446
5,884,134 A * 3/1999 Karashima et al. ..... 399/316
5,923,921 A * 7/1999 OuYang et al. ..... 399/317
6,029,037 A * 2/2000 Ito
6,055,409 A 4/2000 Richards et al. ..... 399/388
6,330,418 B1 * 12/2001 Ahl et al. ..... 399/316
6,496,673 B2 * 12/2002 Bessho

FOREIGN PATENT DOCUMENTS

EP 1 109 077 6/2001

* cited by examiner

*Primary Examiner*—Susan S.Y. Lee
(74) *Attorney, Agent, or Firm*—Kevin R. Kepner

(57) ABSTRACT

A transfer assist blade for an electrophotograhic printing machine that provides the necessary stiffness to allow complete transfer of a toner image while avoiding excessive bending stress in the blade. The blade is made up of a semiconductive polyester layer bonded to a non-semiconductive polyester layer. A third and fourth layer of high molecular weight polyethylene are bonded o the second layer. These third and fourth layers do not extend the full length of the blade to provide supplemental stiffness while avoiding excess bending stress.

8 Claims, 5 Drawing Sheets

COMPOSITE TRANSFER ASSIST BLADE

This application is based on a provisional application No. 60/315,228, filed Aug. 27, 2001.

This invention relates generally to an image transfer device and more particularly, concerns a composite transfer assist blade to contact a sheet in a transfer zone on a photoreceptive member to allow more complete transfer of the image developed thereon to the sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color.

In single pass color machines it is desirable to cause as little disturbance to the photoreceptor as possible so that motion errors are not propagated along the belt to cause image quality and color separation registration problems. One area that has potential to cause such a disturbance is when a sheet is released from the guide after having been brought into contact with the photoreceptor for transfer of the developed image thereto. This disturbance which is often referred to as trail edge flip can cause image defects on the sheet due to the motion of the sheet during transfer caused by energy released due to the bending forces of the sheet. Particularly in machines which handle a large range of paper weights and sizes it is difficult to have a sheet guide which can properly position any weight and size sheet while not causing the sheet to oscillate after having come in contact with the photoreceptor.

It is therefore desirable to have a pretransfer sheet guide that can handle a wide variety of sheet weights and sizes while maintaining the capability to align and deliver the sheet to the photoreceptor with as little impact and sheet motion as possible.

In accordance with one aspect of the present invention, there is provided a composite transfer assist blade, comprising a plurality of layers wherein at least one of said plurality of layers comprises a polyester material having a semiconductive coating thereon, a second one of said plurality of layers comprising a second polyester material bonded to said first polyester layer and a third one of said plurality of layers comprising a high molecular weight polyethylene material bonded to said second polyester material.

In accordance with another aspect of the invention there is provided an electrophotographic printing machine having a photoreceptive member and including a composite transfer assist blade, comprising a plurality of layers wherein at least one of said plurality of layers comprises a polyester material having a semiconductive coating thereon, a second one of said plurality of layers comprising a second polyester material bonded to said first polyester layer and a third one of said plurality of layers comprising a high molecular weight polyethylene material bonded to said second polyester material.

Other features of the present invention will become apparent as the following description proceeds and upon reference to the drawings, in which.

This invention relates to printing system which is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multi-pass color process system, a single or multiple pass highlight color system and a black and white printing system.

Figure 1:
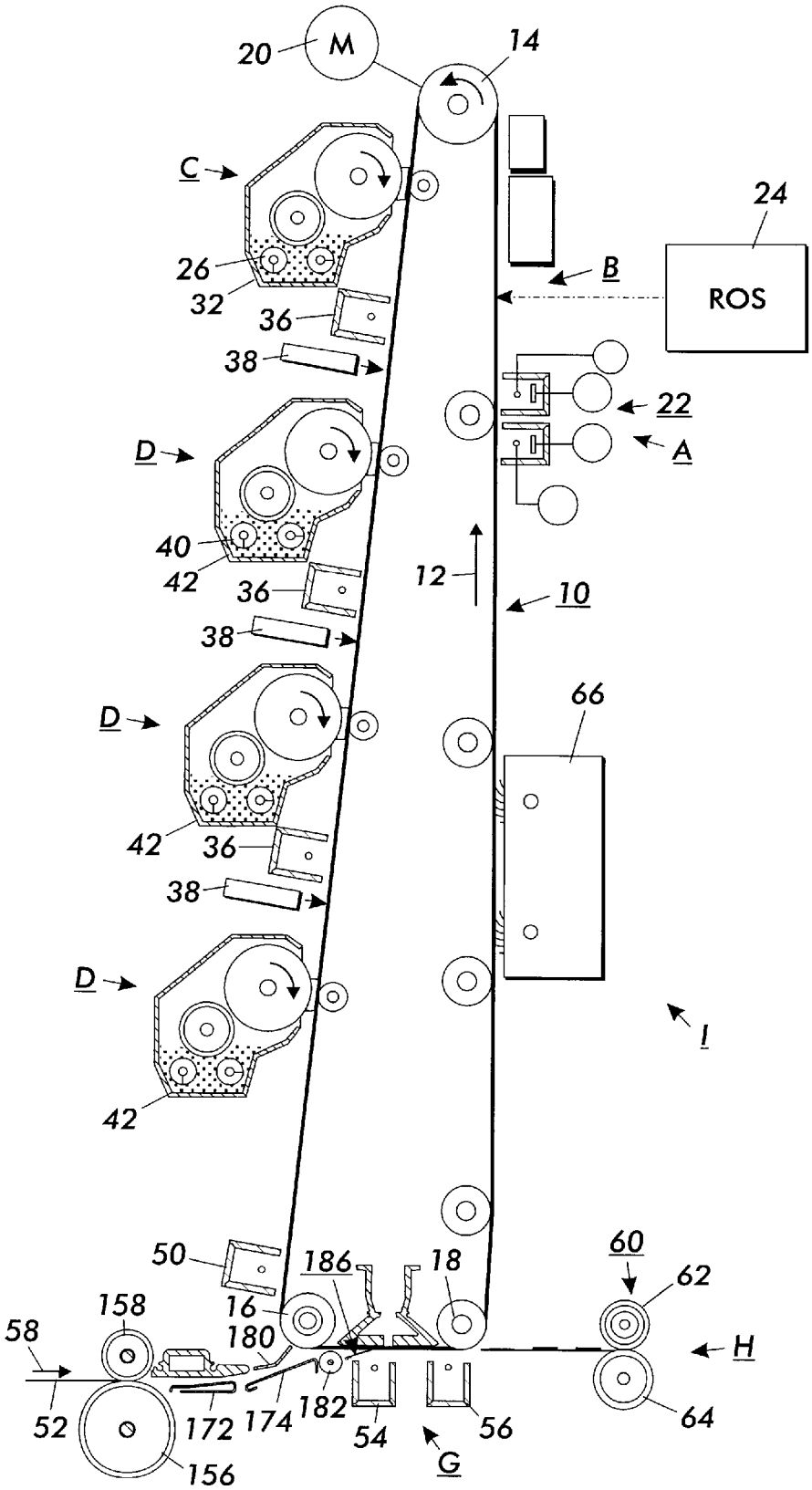
FIG. 1 is a schematic elevational view of a full color image-on-image single-pass electrophotographic printing machine utilizing the device described herein.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and tension and steering rollers 16 and 18 respectively, roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_c$, undergoes dark decay to a level $V_{ddp}$ equal to about −500 volts. When exposed at the exposure station B it is discharged to $V_{image}$ equal to about —50 volts. Thus after exposure, the photoreceptor contains a monopolar voltage profile of high and low voltages, the former corresponding to charged areas and the latter corresponding to discharged or image areas.

At a first development station C, developer structure, indicated generally by the reference numeral 32 utilizing a hybrid jumping development (HJD) system, the development roll, better known as the donor roll, is powered by two development fields (potentials across an air gap). The first field is the AC jumping field which is used for toner cloud generation. The second field is the DC development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (magenta, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by imaging device 38 which comprises a laser based output structure and is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as cyan and for a fourth image and suitable color toner such as black. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by a sheet feeding apparatus to the pretransfer device of the present invention which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
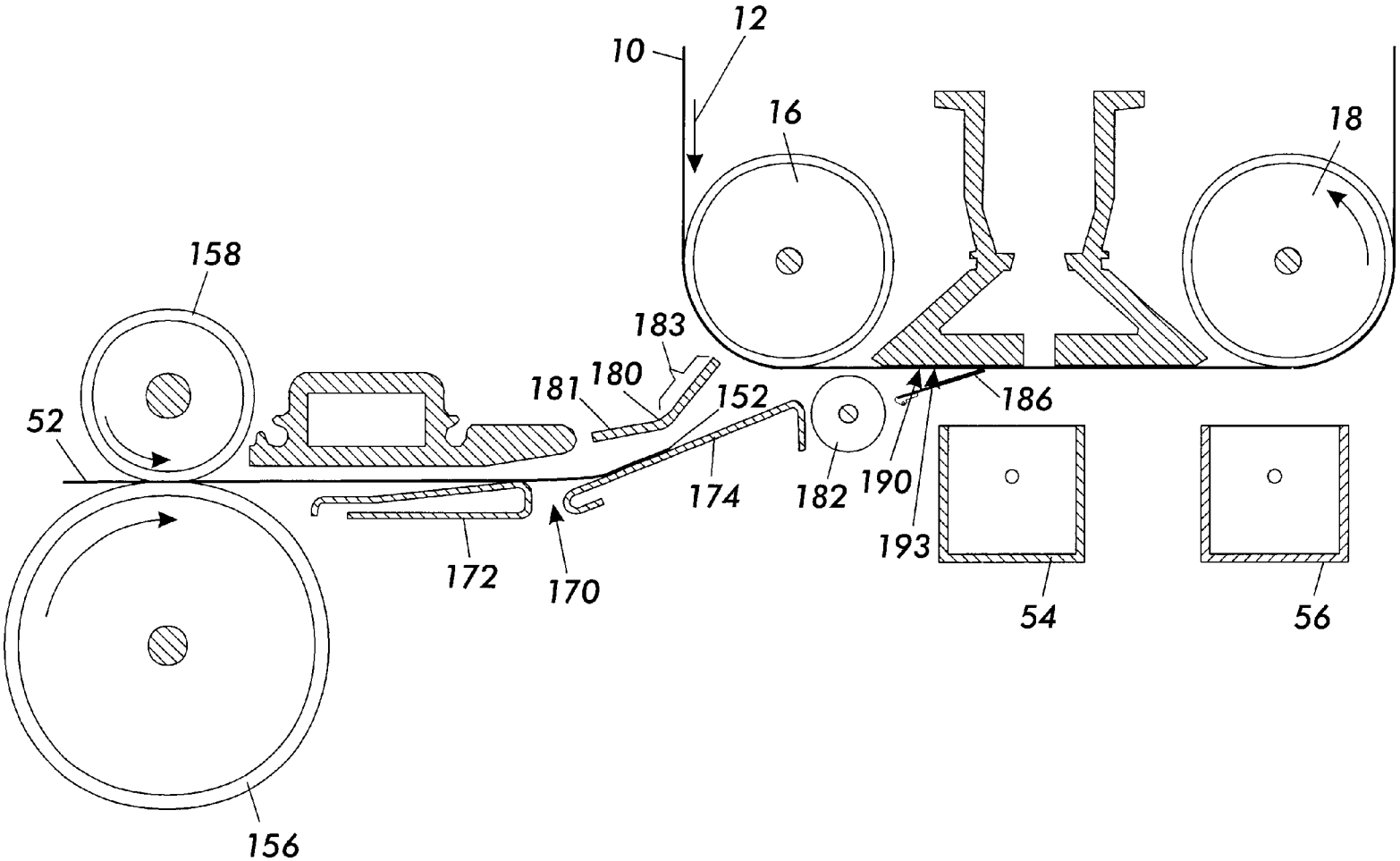
FIG. 2 is a side view illustrating the pretransfer device relative to the FIG. 1 printing machine.

As shown in FIG. 2, the device transports/transitions a sheet with precision to the photoreceptor belt. It minimizes variations in impact and tangency contact locations prior/during transfer and yet is flexible enough to allow sheet delivery at minimal drive and contact forces. The low contact forces eliminate sheet marking on sensitive paper substrates. It also accurately controls sheet placement during conditions of extreme curl (nominally +/−100 mm radii for 34 gsm weight and +/−250 mm radii for 271 gsm weight paper) with consistent photoreceptor (P/R) belt contacts and tangencies.

As the energy that a sheet will generate due to bending is approximately inversely proportional to the cube of the beam length of the sheet it is important to provide the longest beam length possible to minimize the deflection energy will still providing precise control of a sheet being delivered to the photoreceptor. Additionally the sheet needs to maintain good contact with the photoreceptor to assure more complete image transfer.

The lead edge 152 of the paper 52 exits nip 160 formed by rolls 158 and 156, and enters the lower pre transfer baffle area 170 (see FIG. 2). This area 170, provides guides 172, 174, 181 to guide the paper during sheet transfer to the photoreceptor 10.

The sheet continues its motion to guides 181 and 182, where sheet contact is made on each guide. Guide 182 is an idler roll which in combination with the control point 180 of guide 181 provide tight control of the sheet and minimize the sheet variations during initial and tangential photoreceptor contact. During conditions of sheet up/down curl, guides 181 and 182 induce reverse stress on the sheet allowing for accurate placement of the sheet lead edge 152 on the photoreceptor 10.

The sheet 52 continues its motion until the sheet contacts the photoreceptor 10. At this point the gap between roll 182 and contact point 190, serves as a gate or control point. At contact point 190, the sheet angle should be greater than 15° but less than 25°. This angle is achieved to reduce sheet contact forces with the photoreceptor 10. Roll 182 may also be spring loaded or otherwise biased to reduce the stress induced on heavier and stiffer paper when it attempts to bend and tack against the P/R belt 10.

Figure 3:
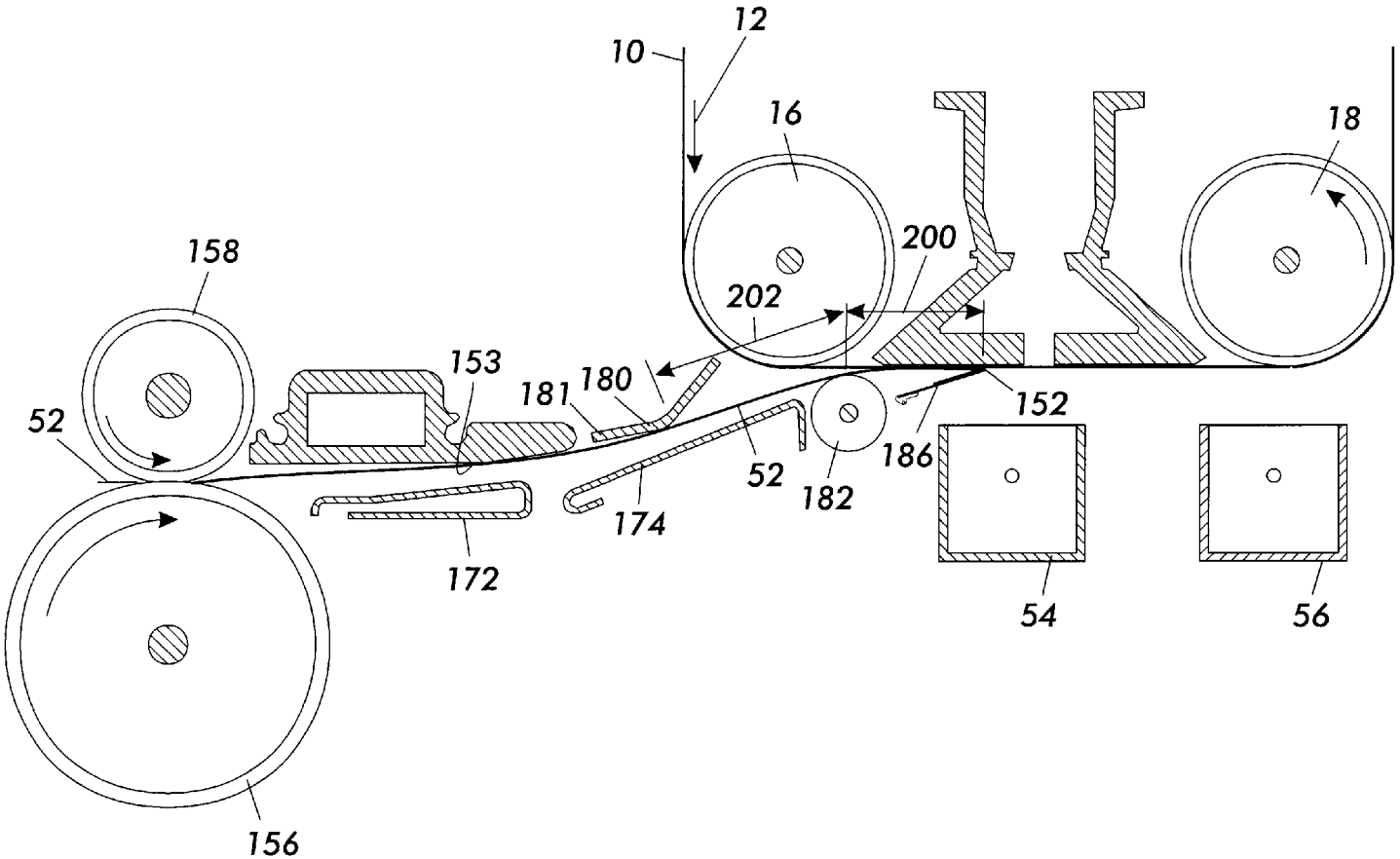
FIGS. 3 and 4 are side views illustrating the pretransfer device baffle function relative to the FIG. 1 printing machine.
Figure 4:
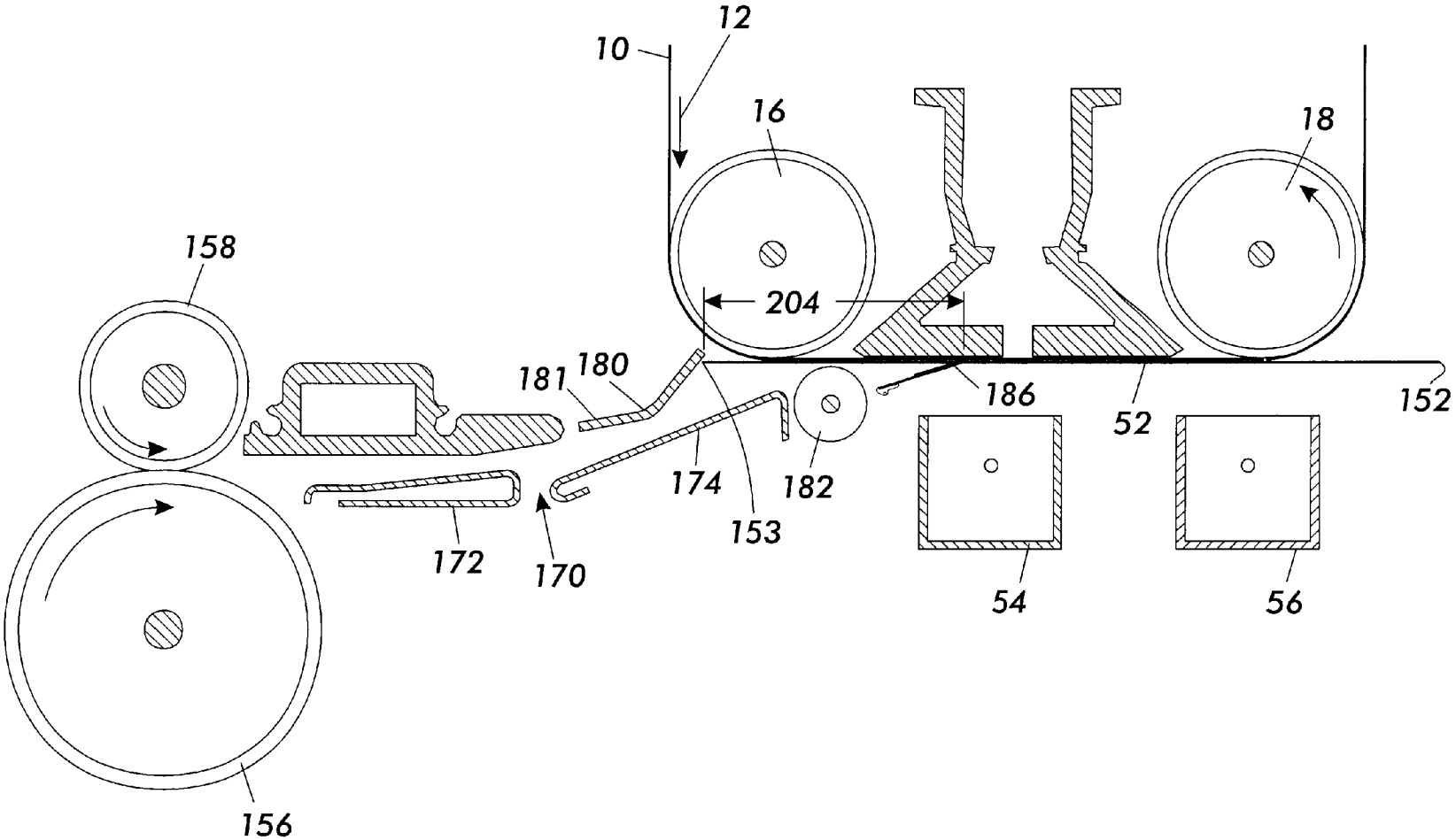

The sheet 52 continues until sheet tangency point 193 occurs on the photoreceptor belt 10. A transfer assist blade contacts the back of the sheet to provide solid contact between the sheet and the photoreceptor to allow more complete transfer of the image. As the sheet progresses onto the photoreceptor it can be seen in FIG. 3 that there are two components of beam length 200, 202 as the sheet is controlled by roll 182 and control point 180 of baffle 181. As the sheet progresses even further as shown in FIG. 4, the trail edge of the sheet is controlled by ramp 183 to minimize the bending stress on the sheet. At this point the beam length as indicated by arrow 204 is considerably longer than it was in FIG. 2 as the sheet is no longer contacting roll 182 and spans from the contact point of the transfer assist blade to the edge of ramp 183.

The device herein virtually eliminates the stalling problem of high stiffness paper at high contact angles by adding a roller at the high paper friction points. Now both high and low stiffness paper can be run at the same contact angle without stalling (paper contact angle on P/R belt 10 preferably less than 20°).

The passive roll 182 in combination with the control point 180 of baffle 181 are strategically located to impart a "reverse" stress to the sheet 52 to act as a passive "decurler" (no moving parts). This dramatically minimizes the variability of the paper contact points on the photoreceptor.

The control points provide stability to the sheet prior to it entering the transfer zone and thus reducing the chances of paper smear, etc. (no paper disturbance upstream) and they provide only two contact points (tangent to the rolls) with the paper which also minimizes the drag force and thus required drive force as opposed to baffles that would provide an inconsistent number of contact points and a higher drag force on the paper. Additionally, the trail edge ramp 183 guides the trail edge 153 of the sheet until it is almost in contact with the photoreceptor which has the benefit of increasing the beam length of the sheet which dramatically reduces the bending energy and subsequent forces which cause print defects due to trail edge flip. Thus, the pretransfer device is further able to deliver the various weight sheets to the photoreceptor with a minimal impact and print defects due to sheet movement.

The composite transfer assist blade overcomes the problems associated with a single component blade. Typically a single component blade in order to be flexible enough to prevent image damage does not provide enough contact force to the back of the sheet to enable complete image transfer giving rise to transfer deletions and color shift. If a thick enough blade is used, the stress on the single blade material is too great. The blade is used to eliminate air gaps between the sheet and the photoreceptor because the presence of air gaps can cause air breakdown in the transfer field, thus causing transfer defects.

Figure 5:
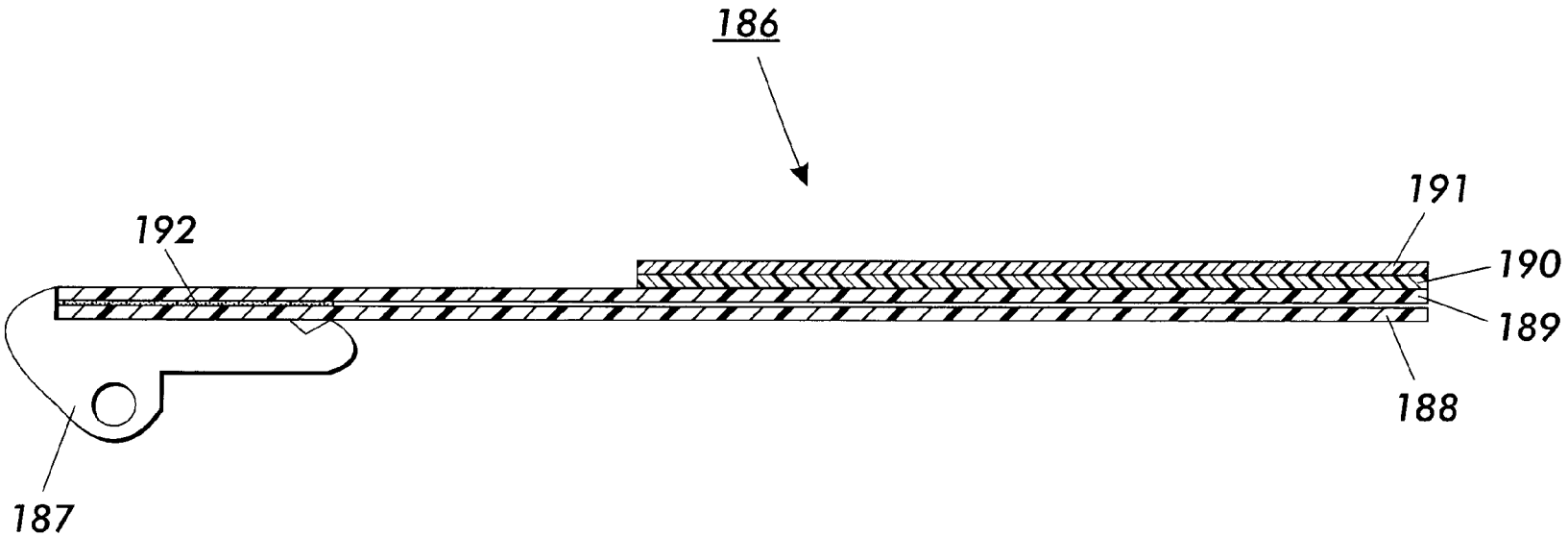
FIG. 5 is a side view of a multi layer composite blade.

The use of the multi layer composite blade 186 as illustrated in FIG. 5 provides a blade that has the necessary contact pressure while maintaining a lower bending stress within each layer. The blade 186 is made up of a plastic bead or mounting portion 186 to which a first layer 188 of electrostatic dispersion material is bonded. This material can be polyester with a semi conductive coating to prevent a field build up on the blade surface facing the charge device 54. A field build up could lead to an image disturbance in the transfer step. The field could impart a tangential force on the toner pile and pull it sideways. This is called "dragout". With a semi-conductive coating, the current that hits the blade assembly is bled away, thereby preventing a field from building. The current bled away can go to ground (it works, but is a waste of energy) or can be returned to the power supply which can then compensate for the current it supplies to that charging device.

The second layer 189 is then bonded to the first layer 188 only in the area of the mounting portion with adhesive 192 to allow the blade layers to flex independently, and is a polyester that is non-semiconductive. There are then bonded to the second layer 189 a third and in some instances a fourth layer of low friction surfaces for wear resistance material. These third and fourth layers are ultra-high molecular weight polyethylene (UHMWPE). Another candidate would be one from the Teflon family (e.g. PTFE). The third 190 and fourth 191 layers do not extend for the full length of the blade as shown in FIG. 5. These third 190 and fourth 191 layers add supplementary stiffness to the blade to assist in more complete transfer of the image.

In recapitulation, there is provided a transfer assist blade for an electrophotographic printing machine that provides the necessary stiffness to allow complete transfer of a toner image while avoiding excessive bending stress in the blade. The blade is made up of a semi-conductive polyester layer bonded to a non-semiconductive polyester layer. A third and fourth layer of high molecular weight polyethylene are bonded o the second layer. These third and fourth layers do not extend the full length of the blade to provide supplemental stiffness while avoiding excess bending stress.

It is, therefore, apparent that there has been provided in accordance with the present invention, a transfer assist blade that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A composite transfer assist blade, comprising a plurality of layers wherein at least one of said plurality of layers comprises a polyester material having a semiconductive coating thereon, a second one of said plurality of layers comprising a second polyester material bonded to said first polyester layer and a third one of said plurality of layers comprising a high molecular weight polyethylene material bonded to said second polyester material.

2. A device according to claim 1, further comprising a fourth one of said plurality of layers comprising a high molecular weight polyethylene bonded to said third one of said plurality of layers.

3. A device according to claim 2, wherein said third one and said fourth one of said plurality of layers comprise a surface area less than a surface area of said first and second one of said plurality of layers.

4. A device according to claim 1, wherein said third one of said plurality of layers comprises a surface area less than a surface area of said first and second one of said plurality of layers.

5. An electrophotographic printing machine having a photoreceptive member and including a composite transfer assist blade, comprising a plurality of layers wherein at least one of said plurality of layers comprises a polyester material having a semiconductive coating thereon, a second one of said plurality of layers comprising a second polyester material bonded to said first polyester layer and a third one of said plurality of layers comprising a high molecular weight polyethylene material bonded to said second polyester material.

6. A printing machine according to claim 5, further comprising a fourth one of said plurality of layers comprising a high molecular weight polyethylene bonded to said third one of said plurality of layers.

7. A printing machine according to claim 6, wherein said third one and said fourth one of said plurality of layers comprise a surface area less than a surface area of said first and second one of said plurality of layers.

8. A printing machine according to claim 5, wherein said third one of said plurality of layers comprises a surface area less than a surface area of said first and second one of said plurality of layers.

* * * * *